US008465251B2

(12) United States Patent
Hosoya et al.

(10) Patent No.: US 8,465,251 B2
(45) Date of Patent: Jun. 18, 2013

(54) COMPRESSOR DEVICE

(75) Inventors: Hiroyuki Hosoya, Nagasaki (JP); Hiroshi Suzuki, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 600 days.

(21) Appl. No.: 12/601,855

(22) PCT Filed: Sep. 25, 2008

(86) PCT No.: PCT/JP2008/067232

§ 371 (c)(1),
(2), (4) Date: Feb. 1, 2010

(87) PCT Pub. No.: WO2009/041460

PCT Pub. Date: Apr. 2, 2009

(65) Prior Publication Data

US 2010/0172741 A1 Jul. 8, 2010

(30) Foreign Application Priority Data

Sep. 28, 2007 (JP) ..... 2007-255303

(51) Int. Cl.
*F01D 25/24* (2006.01)

(52) U.S. Cl.
USPC ..... 415/58.2; 415/58.4; 415/58.6; 415/119

(58) Field of Classification Search
USPC ..... 415/52.1, 58.2, 58.3, 58.4, 58.6, 415/203, 206, 119
See application file for complete search history.

(56) References Cited

U.S. PATENT DOCUMENTS 4,990,053 A * 2/1991 Rohne ..... 415/58.4
5,246,335 A 9/1993 Mitsubori et al.
5,333,990 A 8/1994 Foerster et al.
6,932,563 B2 * 8/2005 Cabrales et al. ..... 415/58.4
2009/0214334 A1 * 8/2009 Fukami ..... 415/206

FOREIGN PATENT DOCUMENTS

| | | | |
|---|---|---|---|
| JP | 3-202699 A | | 9/1991 |
| JP | 3-229998 A | | 10/1991 |
| JP | 4-125633 U | | 11/1992 |
| JP | 5-509142 A | | 12/1993 |
| JP | 10-227299 | * | 8/1998 |
| JP | 10-227299 A | | 8/1998 |
| JP | 2004-27931 A | | 1/2004 |
| JP | 2006-194161 A | | 7/2006 |
| JP | 2007-127108 A | | 5/2007 |
| JP | 2007-127109 A | | 5/2007 |
| JP | 2007-255303 A | | 10/2007 |

OTHER PUBLICATIONS

Decision to Grant a Patent issued August 30, 2012 for Chinese Patent Application No. 200880020431.7 with English translation.
Korean Notice of Allowance issued in Korean Patent Application No. 10-2009-7026069 on Dec. 26, 2012.

* cited by examiner

*Primary Examiner* — Edward Look
*Assistant Examiner* — William Grigos
(74) *Attorney, Agent, or Firm* — Birch, Stewart, Kolasch & Birch, LLP

(57) ABSTRACT

There is provided a compressor device in which resonance in a circulating channel is reduced so that an increase in noise generated from the compressor device is prevented. The compressor device includes: a plurality of blades rotated about a rotation axis; an air inlet extending along the rotation axis and introducing air to the blades; a circulating channel disposed on a circumference centered on the rotation axis and communicating between the air inlet and the shroud of the blades; and a strut extending radially centered on the rotation axis and dividing the circulating channel. Resonance frequencies determined from circumferential lengths in the circulating channels divided by the strut are higher than a noise frequency determined from the rotational speed of the blades and the number of blades.

6 Claims, 3 Drawing Sheets

COMPRESSOR DEVICE

BACKGROUND OF THE INVENTION

1. Field of the Invention

The present invention relates to a compressor device.

2. Description of the Related Art

A known technology in the related art provides an air circulating channel between an air inlet and the shroud of an impeller in the housing of a compressor device to increase the operating range of the compressor device (for example, refer to Patent Document 1).

Patent Document 1: Japanese Unexamined Patent Application, Publication No. 2004-027931

SUMMARY OF THE INVENTION

However, simply providing a circulating channel as in the above technology may cause resonance in the circulating channel under some operating conditions of the compressor device. Specifically, when the frequency of noise caused by the rotation of the blades which compress air matches the resonance frequency of the circulating channel, resonance may occur. Such resonance in the circulating channel disadvantageously increases noise caused by the operation of the compressor device.

The frequency of the noise caused by the rotation of the blades is determined mainly from the rotational speed of the blades (N) and the number of blades (Z). The noise is hereinafter referred to as NZ noise.

The present invention has been made to solve the above problem. Accordingly, it is an object of the present invention to provide a compressor device in which resonance in the circulating channel is reduced so that an increase in noise generated from the compressor device can be prevented.

The present invention provides the following solutions to achieve the above object.

According to a first aspect of the present invention, there is provided a compressor device including a plurality of blades rotated about a rotation axis; an air inlet extending along the rotation axis and introducing air to the blades; a circulating channel disposed on a circumference centered on the rotation axis and communicating between the air inlet and the shroud of the blades; and a strut extending radially centered on the rotation axis and dividing the circulating channel. Resonance frequencies determined from circumferential lengths in the circulating channels divided by the strut are higher than a noise frequency determined from the rotational speed of the blades and the number of blades.

According to the first aspect of the present invention, the resonance frequencies in the circulating channels are higher than the noise frequency determined from the rotational speed and the number of blades, that is, the frequency of the NZ noise. This reduces the occurrence of resonance in the circulating channels.

In particular, when the rotational speed of the blades is set to the maximum rotational speed of the blades of the compressor device according to the present invention, the occurrence of resonance can be reduced in the whole operating range of the compressor device of the present invention.

According to a second aspect of the present invention, there is provided a compressor device including a plurality of blades rotated about a rotation axis; an air inlet extending along the rotation axis and introducing air to the blades; a circulating channel disposed on a substantially cylindrical member having the rotation axis in the interior thereof and communicating between the air inlet and the shroud of the blades; and a strut extending radially centered on the rotation axis and dividing the circulating channel. The circumferential lengths in the circulating channels divided by the strut differ from one circulating channel to another.

According to the second aspect of the present invention, the circumferential lengths in the circulating channels are different, so that the resonance frequencies of the circulating channels are also different. In other words, the frequencies at which resonance occurs vary among the circulating channels. This decreases the loudness of resonance as compared with a case in which resonance occurs in all the circulating channels at the same time.

It is preferable that, in the first or second aspect of the present invention, the surfaces of the strut opposite the circulating channels are formed of curved surfaces.

In this structure, the surfaces opposite the circulating channels are formed of curved surfaces. This increases the resonance frequencies of the circulating channels as compared with a case in which the surfaces of the strut opposite the circulating channels are flat. Thus, the resonance frequencies of the circulating channels can easily be made higher than the frequency of the NZ noise, so that the occurrence of resonance in the circulating channels can easily be reduced.

It is preferable that, in the first or second aspect of the present invention, the circumferential length of the strut centered on the rotation axis change along the rotation axis.

In this structure, the circumferential length of the strut is changed along the rotation axis so that the circumferential length of the circulating channel is also changed along the rotation axis. Thus, the resonance frequencies of the circulating channels are also changed along the rotation axis. This causes resonance only at part of the circulating channels where the frequencies match the frequency of the NZ noise. Thus, the area in which resonance occurs is smaller than that of a case in which the circumferential length of the circulating channel is fixed, so that the loudness of generated resonance can be reduced.

The compressor device according to the first aspect of the present invention is constructed such that the resonance frequencies of the circulating channels are higher than the noise frequency determined from the rotational speed and the number of blades, that is, the frequency of the NZ noise. This offers the advantage of reducing the occurrence of resonance in the circulating channels to prevent an increase in noise generated from the compressor device.

The compressor device according to the second aspect of the present invention is constructed such that the frequencies generated in the circulating channels are different. This offers the advantage of reducing the loudness of resonance to prevent an increase in noise generated from the compressor device as compared with a case in which resonance occurs in all the circulating channels at the same time.

EXPLANATION OF REFERENCE SIGNS

1, 101, 201, 301: compressor (compressor device)
4: air intake channel (air inlet)
5, 105, 205, 305: circulating channel
9, 109, 209, 309: strut
11: blade
C: rotation axis

DETAILED DESCRIPTION OF THE INVENTION

First Embodiment

A first embodiment of the present invention will be described with reference to FIGS. 1 and 2.

Figure 1:
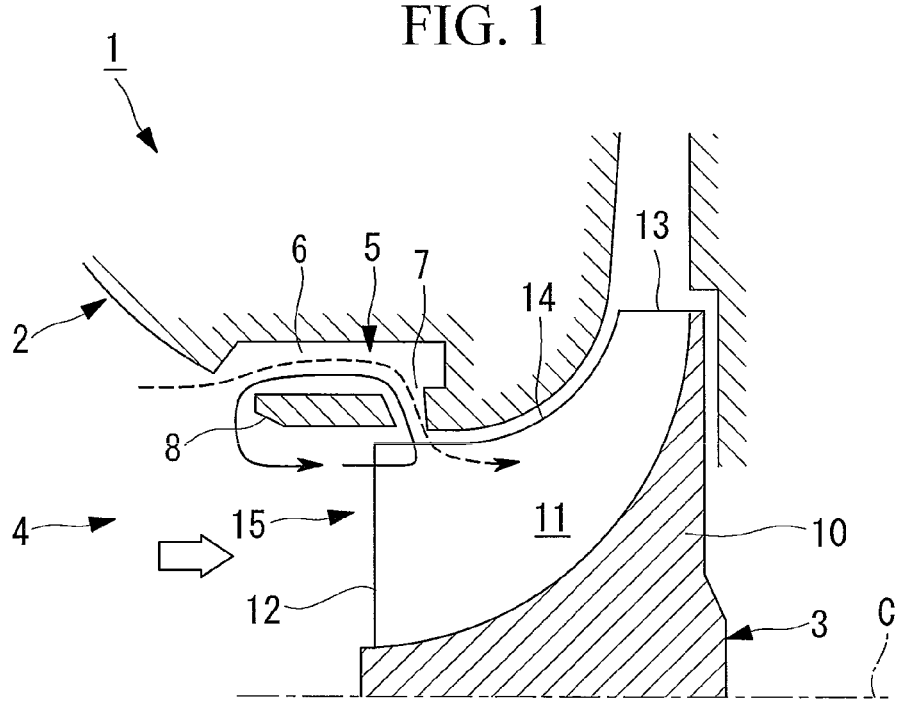
FIG. 1 is a sectional view illustrating the structure of a compressor of a turbocharger according to a first embodiment of the present invention.

FIG. 1 is a sectional view illustrating the structure of the compressor of a turbocharger according to this embodiment. FIG. 2 is a plan view illustrating the structure of the compressor in FIG. 1.

In this embodiment, a compressor device according to the invention in this application is described when applied to the compressor of a turbocharger powered by exhaust gas or the like from an internal combustion apparatus such as an engine.

Figure 2:
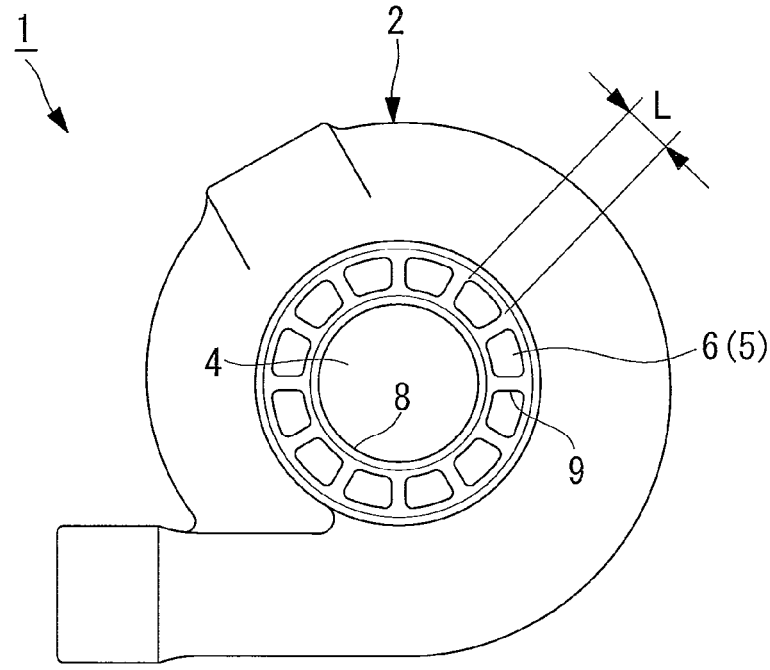
FIG. 2 is a plan view illustrating the structure of the compressor in FIG. 1.

As shown in FIGS. 1 and 2, the compressor (compressor device) 1 of a turbocharger includes a casing 2 that forms the outer shape and an impeller 3 that compresses air.

The casing 2 forms the outer shape of the compressor 1 and a turbine (not shown) that constitute the turbocharger of this embodiment. The turbine extracts rotary driving force from the exhaust gas of the above-mentioned internal combustion apparatus or the like, and supplies the extracted rotary driving force to the impeller 3 of the compressor 1.

The casing 2 accommodates, in its interior, the impeller 3 that is supported rotatably about a rotation axis C and is provided with an air intake channel (air inlet) 4 that introduces air, before being compressed, to the impeller 3 and circulating channels 5 that communicate between the air intake channel 4 and a shroud, to be described later.

The air intake channel 4 is a cylindrical channel extending substantially coaxially with the rotation axis C and is arranged at the air intake end of the impeller 3.

The circulating channels 5 are each constituted by a chamber 6 formed in the casing 2 so as to enclose the upstream end of the impeller 3, and a slit 7 communicating between the chamber 6 and the shroud 15.

The chambers 6 are separated from the air intake channel 4 located at the inside in the radial direction by a substantially cylindrical inner wall 8 and are separated from circumferentially adjacent chambers 6 by radially extending struts 9 that span the casing 2 and the inner wall 8.

In this embodiment, 12 struts 9 are arranged circumferentially at regular intervals. The chambers 6 partitioned by the struts 9 have substantially the same shape. At least part of the surface of each strut 9 opposite the chambers 6, that is, the circumferential surfaces, each have a flat area. Specifically, even when the connected part between the strut 9 and the inner wall 8 and the connected part between the strut 9 and the casing 2 have corners having a radius of curvature, the strut 9 has a flat area between the corners.

The slits 7 are notches provided in the inner wall 8. The slits 7 each communicate between the end of the chamber 6 adjacent to the impeller 3 and the shroud 15.

The end of the chamber 6 at the opposite side from the impeller 3, that is, the upstream end, communicates with the air intake channel 4.

The impeller 3 has a hub 10 that is rotated about the rotation axis C and a plurality of blades 11 that is rotated together with the hub 10.

The hub 10 is mounted to a rotation shaft (not shown) and has the plurality of blades 11 on the radially outer surface.

The blades 11 compress air taken from the air intake channel 4 when rotated. The blades 11 may be of a known shape and are not particularly limited in form.

The blades 11 each have a front edge 12, which is an upstream edge, a rear edge 13, which is a downstream edge, and an outer free edge 14, which is an outer radial edge.

In this embodiment, the outer radial portion of the impeller 3 is referred to as the shroud 15. Specifically, the shroud 15 is a portion including the blade 11, particularly, the outer free edge 14.

Next, the structure of the circulating channels 5, which is a feature of this embodiment, will be described.

The shape of the circulating channels 5 is configured so that its resonance frequency $f_R$ is higher than the frequency $f_{NZ}$ of a predetermined noise generated by the impeller 3. The predetermined noise is a noise whose frequency is determined from the rotational speed (N) of the impeller 3 and the number (Z) of the blades 11, so-called NZ noise.

The resonance frequency $f_R$ of the circulating channels 5 is expressed as Eq. (1), and the frequency $f_{NZ}$ of the NZ noise is expressed as Eq. (2).

$$f_R = C/(2L) \tag{1}$$

$$f_{NZ} = NZ/60 \tag{2}$$

where C is the velocity of sound and L is the length of the chamber 6 of the circulating channel 5 along the circumference, centered on the rotation axis C (hereinafter referred to as a circumferential length).

The circumferential length L of the chamber 6 of the circulating channel 5 at which resonance with the NZ noise occurs is expressed as Eq. (3), based on Eq. (1) and Eq. (2).

$$C/(2L) = NZ/60$$

$$L = (C/2)\times(60/NZ) = 30C/NZ \tag{3}$$

Accordingly, setting the circumferential length L of the chamber 6 shorter than the value obtained by Eq. (3) allows the resonance frequency $f_R$ of the circulating channel 5 to be higher than the frequency $f_{NZ}$ of the NZ noise. Particularly, setting the resonance frequency $f_R$ of the circulating channel 5 higher than the maximum rotational speed of the impeller 3 of this embodiment, that is, the frequency $f_{NZ}$ of the NZ noise at the maximum rotational speed of the compressor 1, reduces the occurrence of resonance in the circulating channel 5.

In this embodiment, the circumferential length L of the chamber 6 is set so that the resonance frequency $f_R$ of the circulating channel 5 is higher than the frequency $f_{NZ}$ of the NZ noise at the maximum rotational speed of the compressor 1.

Eqs. (1) and (3) are applied to the shape of the circulating channel 5 of this embodiment. When the circulating channel 5 has a different shape, other equations, specifically, equations having different coefficients, are applied. That is, Eqs. (1) and (3) are generally expressed as the following Eqs. (4) and (5).

$$f_R = c1\times C/L \tag{4}$$

$$L = 60c1\times C/(NZ) \tag{5}$$

where c1 is a coefficient determined by the shape of the circulating channel 5.

Next, the flow of air in the compressor 1 with the above structure will be described.

As shown in FIG. 1, the impeller 3 of the compressor 1 is rotated about the rotation axis C by the rotary driving force generated by a diffuser (not shown). The air is taken into the impeller 3 through the air intake channel 4, increased mainly in dynamic pressure through the plurality of blades 11, and then flows into the diffuser (not shown) disposed at the outer side in the radial direction, where part of the dynamic pressure is converted to static pressure. The air increased in pressure in this way is supplied to the internal combustion apparatus or the like.

At that time, the pressure in the chamber 6 becomes higher than the pressure in the air intake channel 4 under conditions close to conditions under which surging occurs in the compressor 1. The air therefore circulates from the shroud 15 of the impeller 3 through the slit 7, the chamber 6, and the air intake channel 4 in that order, as shown by the solid line in FIG. 1.

In contrast, if the quantity of air that passes through the compressor 1 is larger than that of surging conditions, the pressure in the chamber 6 becomes lower than the pressure in the air intake channel 4. The air therefore flows from the air intake channel 4 through the chamber 6, the slit 7, and the shroud 15 to the impeller 3, as shown by the dotted line in FIG. 1.

When the compressor 1 is operated under varied operating conditions, that is, at a varied rotational speed, as described above, the frequency $f_{NZ}$ of the NZ noise also varies with the changes in rotational speed.

However, the resonance frequency $f_R$ of the circulating channel 5 does not resonate with the NZ noise because the resonance frequency $f_R$ is set higher than the frequency $f_{NZ}$ of the NZ noise.

The above structure prevents the occurrence of resonance in the circulating channel 5 because the resonance frequency $f_R$ of the circulating channel 5 is higher than the frequency $f_{NZ}$ of the NZ noise, which is determined from the rotational speed (N) and the number (Z) of the blades 11.

In particular, setting the rotational speed (N) of the blades 11 to the maximum rotational speed of the blades 11 of the compressor 1 of this embodiment prevents the occurrence of resonance in the whole operating range of the compressor 1 of this embodiment.

Second Embodiment

Figure 3:
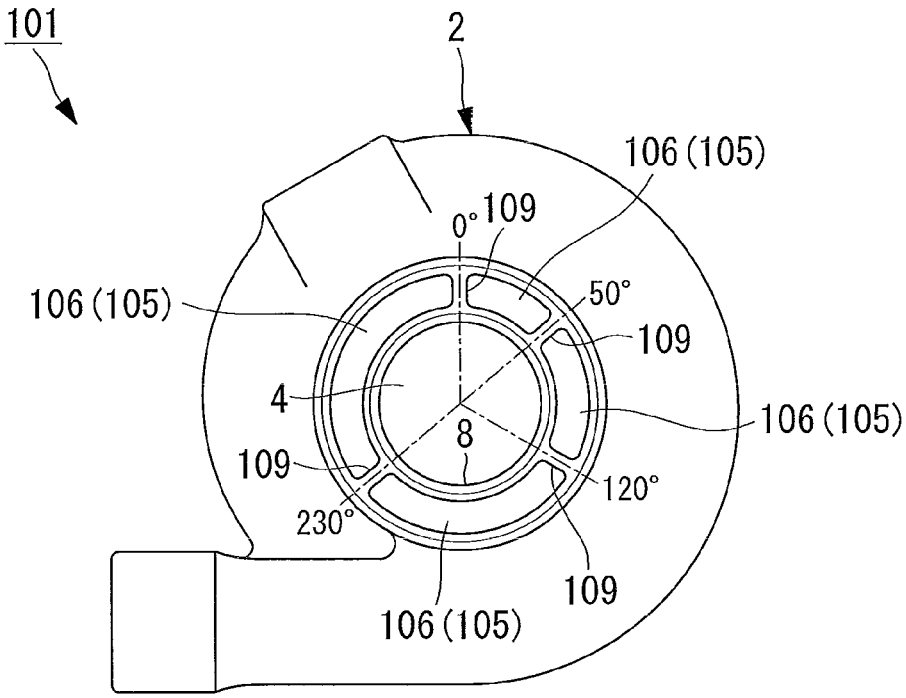
FIG. 3 is a schematic diagram illustrating the structure of circulating channels of a compressor according to a second embodiment of the present invention.

Referring next to FIG. 3, a second embodiment of the present invention will be described.

The compressor of this embodiment is similar to the first embodiment in basic structure but different in the structure of the circulating channels. Thus, in this embodiment, only the structure of the circulating channels will be described with reference to FIG. 3, and descriptions of the other components will be omitted.

FIG. 3 is a schematic diagram illustrating the structure of the circulating channels of the compressor according to this embodiment.

The same components as those of the first embodiment are given the same reference signs and their descriptions will be omitted.

As shown in FIG. 3, the casing 2 of the compressor (compressor device) 101 accommodates, in its interior, the impeller 3 (see FIG. 1) rotatably supported about the rotation axis C (see FIG. 1) and is provided with the air intake channel 4 that introduces air, before being compressed, to the impeller 3 and circulating channels 105 that communicate between the air intake channel 4 and the shroud 15.

The circulating channels 105 are each constituted by a chamber 106 formed in the casing 2 so as to enclose the upstream end of the impeller 3, and the slit 7 (see FIG. 1) that communicates between the chamber 106 and the shroud 15.

The chambers 106 are separated from the air intake channel 4 located at the inside in the radial direction by the substantially cylindrical inner wall 8 and are separated from circumferentially adjacent chambers 106 by radially extending struts 109 that span the casing 2 and the inner wall 8.

In this embodiment, four struts 109 are arranged circumferentially at irregular intervals. The chambers 106 partitioned by the struts 109 have different shapes. Specifically, the struts 109 are arranged at phase positions of about 50°, 120°, and 230° in the clockwise direction from a reference strut 109 (at a phase of 0°).

At least part of the circumferential surfaces of the struts 109 each have a flat area, as in the first embodiment.

Since the flow of air in the compressor 101 with the above structure is similar to that of the first embodiment, its description will be omitted.

Reduction of resonance in the compressor 101 with the above structure will be described next.

In the case of the circulating channel 105 of this embodiment, the struts 109 are arranged irregularly, so that the circumferential lengths L of the chambers 106 partitioned by the struts 109 are also different.

Thus, the resonance frequencies $f_R$ among the circulating channels 105 are also different, so that resonance occurs in the circulating channels 105 under different operating conditions of the compressor 101, that is, at different rotational speeds. In other words, since the frequency $f_R$ at which resonance occurs changes among the circulating channels 105, the loudness of the resonance can be reduced as compared with a case in which resonance occurs in all the circulating channels at the same time.

Third Embodiment

Figure 4:
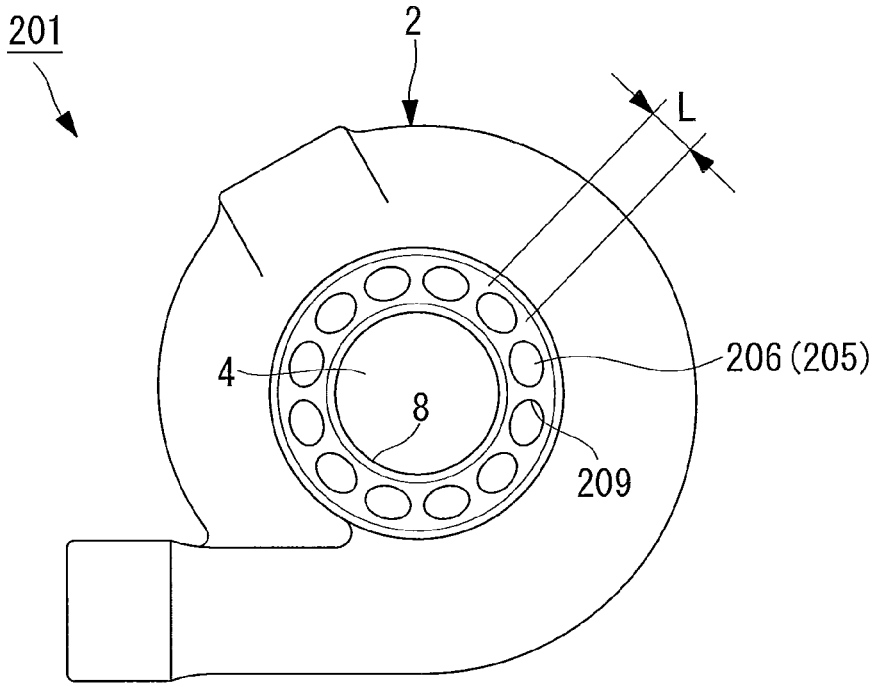
FIG. 4 is a schematic diagram illustrating the structure of circulating channels of a compressor according to a third embodiment of the present invention.

Referring to FIG. 4, a third embodiment of the present invention will be described.

The compressor of this embodiment is similar to the first embodiment in basic structure but different in the structure of the circulating channels. Thus, only the structure of the circulating channels will be described with reference to FIG. 4, and descriptions of the other components will be omitted.

FIG. 4 is a schematic diagram illustrating the structure of the circulating channels of the compressor according to this embodiment.

The same components as those of the first embodiment are given the same reference signs and their descriptions will be omitted.

As shown in FIG. 4, the casing 2 of the compressor (compressor device) 201 accommodates, in its interior, the impeller 3 (see FIG. 1) rotatably supported about the rotation axis C (see FIG. 1) and is provided with the air intake channel 4 that introduces air, before being compressed, to the impeller 3 and circulating channels 205 that communicate between the air intake channel 4 and the shroud 15.

The circulating channels 205 are each constituted by a chamber 206 formed in the casing 2 so as to enclose the upstream end of the impeller 3, and the slit 7 (see FIG. 1) that communicates between the chamber 206 and the shroud 15.

The chambers 206 are separated from the air intake channel 4 located at the inside in the radial direction by the substantially cylindrical inner wall 8. The chambers 6 are each separated from circumferentially adjacent chambers 206 by radially extending struts 209 that span the casing 2 and the inner wall 8.

The circumferential surfaces of the struts 209 are each formed of only a curved surface. In other words, the connected part between the strut 9 and the inner wall 8 and the connected part between the strut 209 and the casing 2 have continuous corners having a radius of curvature, with no flat portion between the corners.

The chambers 206 partitioned by such struts 209 may be, for example, circular or elliptic in channel cross section, but are not particularly limited provided that the struts 209 at least have the shape described above.

Since the flow of air in the compressor 201 with the above structure is similar to that of the first embodiment, its description will be omitted.

Reduction of resonance in the compressor 201 with the above structure will be described next.

The resonance frequency $f_R$ of the circulating channel 205 of this embodiment is expressed as Eq. (6) below.

$$f_R=1.22C/L \quad (6)$$

In other words, the resonance frequency $f_R$ of the circulating channel 205 of this embodiment is higher than the resonance frequency $f_R$ of the circulating channel 5 of the first embodiment under the same conditions. Accordingly, with the compressor 201 of this embodiment, the resonance frequency $f_R$ of the circulating channel 205 can easily be made higher than the frequency $f_{NZ}$ of the NZ noise so that the occurrence of resonance in the circulating channel 205 can easily be reduced.

Fourth Embodiment

Figure 5:
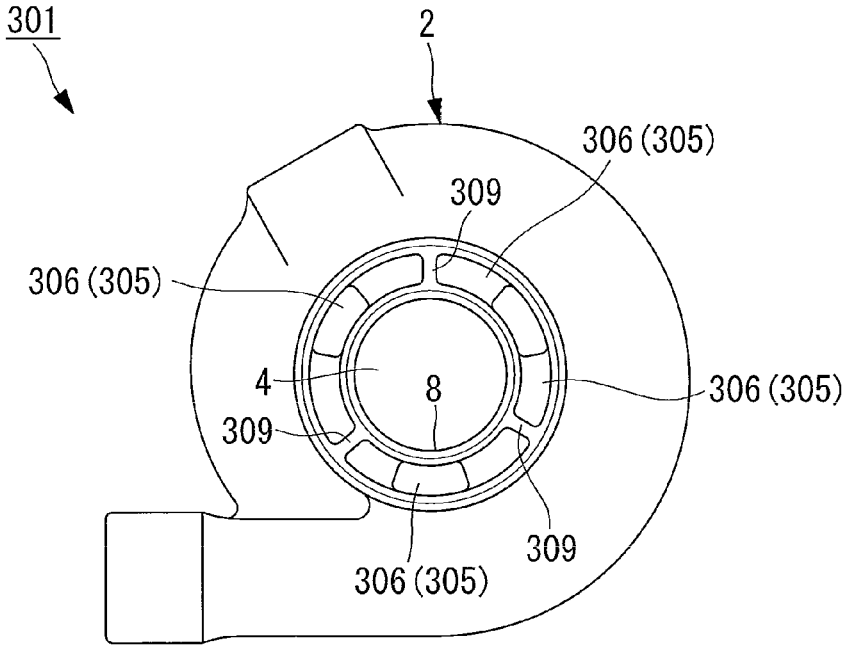
FIG. 5 is a schematic diagram illustrating the structure of circulating channels of a compressor according to a fourth embodiment of the present invention.

Referring now to FIG. 5, a fourth embodiment of the present invention will be described.

The compressor of this embodiment is similar to the first embodiment in basic structure but different in the structure of the circulating channels. Therefore, only the structure of the circulating channels will be described with reference to FIG. 5, and descriptions of the other components will be omitted.

Figure 6:
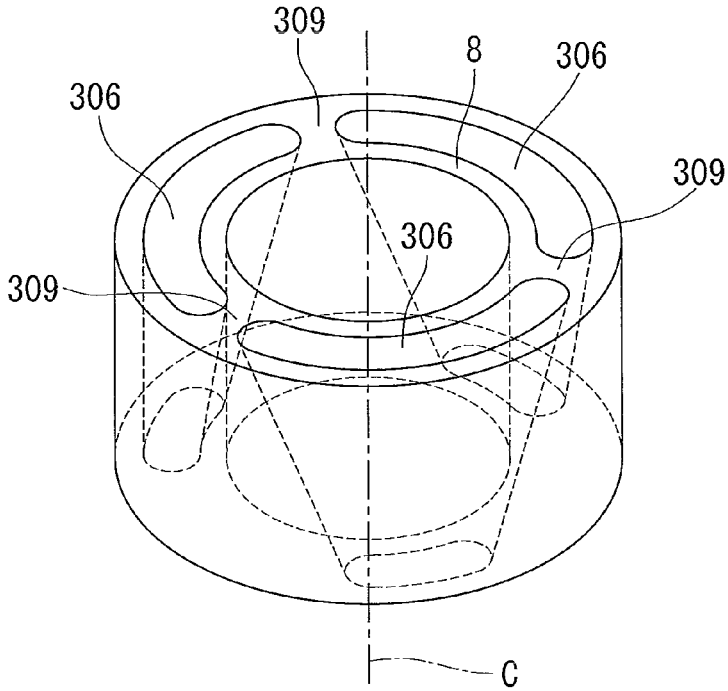
FIG. 6 is a fragmentary perspective view illustrating the structure of the circulating channels in FIG. 5.

FIG. 5 is a schematic diagram illustrating the structure of the circulating channels of the compressor of this embodiment. FIG. 6 is a fragmentary perspective view illustrating the structure of the circulating channels in FIG. 5.

The same components as those of the first embodiment are given the same reference signs and their descriptions will be omitted.

As shown in FIGS. 5 and 6, the casing 2 of the compressor (compressor device) 301 accommodates, in its interior, the impeller 3 rotatably supported about the rotation axis C and is provided with the air intake channel 4 that introduces air, before being compressed, to the impeller 3 and circulating channels 305 that communicate between the air intake channel 4 and the shroud 15.

The circulating channels 305 are each constituted by a chamber 306 formed in the casing 2 so as to enclose the upstream end of the impeller 3, and the slit 7 that communicates between the chamber 306 and the shroud 15.

The chambers 306 are separated from the air intake channel 4 located at the inside in the radial direction by the substantially cylindrical inner wall 8. The chambers 6 are each separated from circumferentially adjacent chambers 306 by radially extending struts 309 that span the casing 2 and the inner wall 8.

The chambers 306 are each formed such that its circumferential length decreases from the upstream end to the downstream end (from above to below in FIG. 5) along the rotation axis C. In other words, the struts 309 are each formed such that its circumferential length increases from the upstream end to the downstream end along the rotation axis C.

The circumferential length of the chamber 306 is not particularly limited; for example, it may decrease from the upstream end to the downstream end, as described above, or alternatively, may increase from the upstream end to the downstream end, may decrease and then increase from the upstream end to the downstream end or, in contrast, may increase and then decrease.

Since the flow of air in the compressor 301 with the above structure is similar to that of the first embodiment, its description will be omitted.

Reduction of resonance in the compressor 301 with the above structure will be described next.

The circulating channels 305 of this embodiment are constructed such that the radial length of the strut 309 increases from the upstream end to the downstream end along the rotation axis C so that the radial length of the chamber 306 of the circulating channel 305 is decreased from the upstream end to the downstream end.

Thus, the resonance frequency $f_R$ of each circulating channel 305 also changes along the rotation axis C, so that the whole circulating channel 305 does not have the same resonance frequency $f_R$. This causes resonance only at part of the circulating channel 305 where the frequency matches the frequency $f_{NZ}$ of the NZ noise. Thus, the area in which resonance occurs is smaller than a case in which the radial length of the circulating channel 305 is fixed, so that the loudness of generated resonance can be reduced.

It is to be understood that the technical scope of the present invention is not limited to the above embodiments and that various modifications may be made without departing from the spirit and scope of the present invention.

For example, although the embodiments of the present invention have been described in terms of a centrifugal compressor, the present invention is not limited to the centrifugal compressor but may be applied to other types of compressor, such as a mixed flow compressor and an axial flow compressor.

The invention claimed is:

1. A compressor device comprising:

a plurality of blades on an impeller rotated about a rotation axis;

an air inlet extending along the rotation axis and introducing air to the blades;

a circulating channel disposed on a circumference of the air inlet and centered on the rotation axis of the impeller and communicating between the air inlet and a shroud of the blades; and a strut extending radially centered on the rotation axis and dividing the circulating channel;

wherein resonance frequencies determined from circumferential lengths in the circulating channels divided by the strut are higher than a noise frequency determined from a rotational speed of the blades and the number of blades, and wherein the circumferential length L of the circulating channel is shorter than a value expressed by the following equation:

$$L=60c1\times C/(NZ),$$

where c1 is a coefficient determined by a shape of the circulating channel, C is the velocity of sound, N is a rotation speed of the blades, and Z is a number of blades.

2. A compressor device comprising:

a plurality of blades rotated about a rotation axis;

an air inlet extending along the rotation axis and introducing air to the blades;

a circulating channel disposed on a substantially cylindrical member having the rotation axis in an interior thereof and communicating between the air inlet and a shroud of the blades; and a strut extending radially centered on the rotation axis and dividing the circulating channel in a circumferential direction of the air inlet;

wherein circumferential lengths in circulating channels divided by the strut differ from one circulating channel to another.

3. The compressor device according to claim 1, wherein surfaces of the strut opposite the circulating channel are formed of curved surfaces.

4. The compressor device according to claim 1, wherein the circumferential length of the strut centered on the rotation axis changes along the rotation axis.

5. The compressor device according to claim 2, wherein surfaces of the strut opposite the circulating channel are formed of curved surfaces.

6. The compressor device according to claim 2, wherein a circumferential length of the strut centered on the rotation axis changes along the rotation axis.

* * * * *